US005511440A

United States Patent [19]

Watanabe et al.

[11] Patent Number: 5,511,440

[45] Date of Patent: Apr. 30, 1996

[54] METHOD OF MANUFACTURING A HOLLOW STEERING SHAFT AND HOLLOW STEERING SHAFT

[75] Inventors: Yasushi Watanabe; Kiyoshi Okubo; Koichi Yokoi, all of Maebashi, Japan

[73] Assignee: NSK Ltd., Tokyo, Japan

[21] Appl. No.: 288,073

[22] Filed: Aug. 10, 1994

[30] Foreign Application Priority Data

Aug. 25, 1993 [JP] Japan ..... 5-230740

[51] Int. Cl.[6] ..... B62D 1/16; B21C 1/22

[52] U.S. Cl. ..... 74/492; 72/282; 72/352

[58] Field of Search ..... 74/492, 493; 280/775, 280/777; 72/282, 352

[56] References Cited

U.S. PATENT DOCUMENTS 5,216,912 6/1993 Tanaka ..... 72/367

FOREIGN PATENT DOCUMENTS 61-14035 1/1986 Japan .

61-219416 9/1986 Japan .

4-11571 1/1992 Japan .

4-317860 11/1992 Japan .

5-200634 8/1993 Japan .

OTHER PUBLICATIONS

Patent Abstracts of Japan, vol. 11, No. 57, (M-564), (2504) 21 Feb. 1987 (JP-A-61 219 416).

*Primary Examiner*—Allan D Herrmann

*Attorney, Agent, or Firm*—Shapiro and Shapiro

[57] ABSTRACT

A hollow steering shaft having a good quality can be manufactured at a low cost by passing a blank tube having a circular cross section through a preliminary shaping die and then through a finishing shaping die. The blank tube which has passed through the preliminary shaping die is formed with two kinds of convex curve surface portions having different radii of curvature and arranged continuously, circumferentially and alternately. When the blank tube passes through the finishing shaping die, the larger convex curve surface portions are deformed into flat portions. As a result, a steering shaft having an elliptical cross section is manufactured.

2 Claims, 10 Drawing Sheets

METHOD OF MANUFACTURING A HOLLOW STEERING SHAFT AND HOLLOW STEERING SHAFT

BACKGROUND OF THE INVENTION

1. Field of the Invention

The present invention relates to a method of manufacturing an inexpensive and good-quality hollow steering shaft of a steering apparatus off a vehicle and such a steering shaft.

2. Related Background Art

A conventional steering apparatus of a vehicle has a structure as shown in FIG. 10, for example. A steering shaft 1 is supported only rotatably in a steering column 2 supported on a vehicle body. A steering wheel (not shown) is fixed to the upper end of the steering shaft 1. The movement of the steering wheel is transmitted to steering gears (not shown) through a universal joint 3 and a transmission shaft 4.

The steering apparatus comprising the steering shaft 1 and the steering column 2 of the conventional type has a so-called collapsible structure which shrinks in its longitudinal direction when it receives a shock so that it protects the driver at the time of collision. As shown in FIG. 10, the steering shaft 1, for example, comprises a hollow cylindrical lower shaft 5 and a solid upper shaft 6 connected thereto. Each of the fitting portions of both shafts 5 and 6 has an elliptical cross section so as to prevent relative rotation therebetween. Synthetic resin members 9 are filled and solidified in annular grooves 7 Formed in the outer peripheral surface of the lower portion of the upper shaft 6 and through holes 8 formed in the upper portion of the lower shaft 5. The synthetic resin members 9 prevent axial displacement between the shafts 5 and 6 in the normal operation of a vehicle. Upon collision, however, they are broken and allow the displacement between the shafts 5 and 6 to shorten the length of the steering shaft 1.

Recently, there have been used more hollow upper shafts **6*a* of steering shafts 1, as shown in FIGS. 11 and 12, in order to make the steering shafts light. Each hollow upper shaft 6*a* is manufactured by drawing a cylindrical blank tube having a circular cross section. On the upper end portion of the upper shaft 6*a* are Formed a spline portion 10 and a male screw 11 which engages a nut For holding a steering wheel mounted on the spline portion 10**.

The lower half of the upper shaft **6*a* forms a substantially elliptical fitting portion 14 comprising a pair of arcuate portions 12 and a pair of flat portions 13 arranged circumferentially and alternately. The fitting portion 14 is inserted in a fitting portion 15 formed on the upper half of the lower shaft 5 (FIG. 10) so that only axial movement between the fitting portions 14 and 15 is allowed. The annular grooves 7 are formed in the outer peripheral surface of the fitting portion 14**.

Conventionally, the fitting portion 14 has been formed on the lower half of the upper shaft **6*a* as shown in FIGS. 13A to 13E. First, a cylindrical blank tube 16 to be formed into an upper shaft 6*a* is disposed so as to face a drawing die 18 fixed in a holding case 17, as shown in FIG. 13A. As shown in detail in FIGS. 14 to 16, the die 18 has a land portion 19 and a tapered portion 20 having cross sectional areas which become smaller as they approach the land portion 19. The inner face of the land portion 19 takes a substantially elliptical shape which is complementary to the outer peripheral surface of the fitting portion 14. The shape of the cross section of the inner face of the tapered portion 20 gradually changes from a circle to a substantial ellipse toward the land portion 19, and an intermediate portion of the tapered portion 20 takes a shape as shown in FIG. 16**.

After an end of the blank tube 16 has been disposed so as to face the die 18 at its large diameter side, a mandrel 21 is inserted into the die 18 from the opposite side to the blank tube 16 and then the front end portion 22 of the mandrel 21 is inserted into the blank tube 16, as shown in FIG. 13B. The shape of the front end portion 22 is similar to the shape of the inner face of the land portion 19, i.e., substantially elliptical.

After the front end portion 22 of the mandrel 21 has been inserted into the blank tube 16, the blank tube 16 is pushed into the die 18. In synchronism with the pushing-in of the blank tube 16, the mandrel 21 is pulled out of the die 18. During this operation, the blank tube 16 is tightly held between the inner face of the land portion 19 and the outer peripheral surface of the mandrel 21 and plastically deformed so as to become substantially elliptical in cross section.

After an elliptically cross-sectioned portion having an ample length has been formed by fully inserting the front end portion of the blank tube 16 into the die 18, the mandrel 21 is pulled out of the blank tube 16, as shown in FIG. 13D, and then the blank tube 16 is also pulled out of the die 18. The blank tube 16 having the required portion drawn so as to be substantially elliptical in cross section is transported to a station where annular grooves 7 are formed.

However, the conventional method of manufacturing a hollow steering shaft in which the required portion of a blank tube 16 is drawn to form a substantially elliptical cross section is subject to the Following problems to be solved.

(1) In order to manufacture a hollow steering shaft having a high quality, the dimensional accuracies, particularly the thickness accuracy, must be controlled very strictly.

When the thickness is too large, use of the mandrel 21 as shown in FIG. 13C remarkably increases a shaping load required for pushing the blank tube 16 into the die 18. As a result, the buckling or the like adverse phenomenon occurs to the blank tube 16 due to the shaping load, hindering smooth shaping operation.

When the thickness is too small, on the other hand, an intermediate part of each flat portion 13 of the elliptically cross-sectioned part of the blank tube 16 is bent inward, and/or the thickness of the connecting portions 23 between the Flat portions 13 and the arcuate portions 12 becomes smaller than the required thickness.

(2) An apparatus for inserting the mandrel and pulling the same out is required. This makes the structure of a shaping apparatus complicated and increases the apparatus cost.

(3) Since the cross sections of the blank tube 16 are changed by holding the blank tube 16 between the land portion 19 of the die 18 and the mandrel 21 under a large force and by squeezing the blank tube 16 to reduce its thickness, the shaping load is very large. Thus, during shaping operation, a high surface pressure is applied to the land portion 19, and the land portion 19 and the outer peripheral surface of the blank tube 16 rub with each other, resulting in quick wear of the land portion 19. In consequence, the die 18 must be changed very frequently, resulting in a high manufacturing cost.

(4) Since the shape of the cross sections is changed by reducing the thickness off the blank tube 16 as described above, the blank tube 16 is elongated during the drawing operation, and it is difficult to control the elongation accurately. Thus, a post-process is required for cutting the blank tubes 16 to the same length. This also contributes to a high manufacturing cost.

When a hollow steering shaft is manufactured, the mandrel 21 which causes the above-mentioned problems might be omitted. If, however, the mandrel 21 is omitted, intermediate parts of the flat portions of a blank tube are likely to be bent inward and/or the connecting portions between the flat portions and the arcuate portions off the blank tube are likely to have insufficient thickness, as is in the case where the thickness is too small.

A hollow steering shaft might be manufactured by the use of a rotary swaging machine. In this case, a mandrel having an elliptical cross section is inserted into a blank tube having a circular cross section, and then the cross section of the blank tube is formed into a substantially elliptical shape by hitting the outer peripheral surface of the blank tube so that the inner diameter of the blank tube reduces. However, this manufacturing method requires a long operation time and a high apparatus cost, and noise is generated during the operation. Thus, this method is not practical.

SUMMARY OF THE INVENTION

An object of the present invention is to provide a method of manufacturing a hollow steering shaft having a high quality at a low manufacturing cost.

In a method of manufacturing a hollow steering shaft according to the present invention, part of a blank tube having a circular cross section passes through a preliminary shaping die and then is pushed into a finishing shaping die, thereby forming a hollow steering shaft having a pair of arcuate portions and a pair of flat portions arranged circumferentially and alternately to form a substantially elliptical cross section. In doing so, a hollow steering shaft having a substantially elliptical cross section is manufactured.

Each of the preliminary shaping and finishing shaping dies is provided with a tapered portion having cross sections which become gradually smaller in the pushing direction of the blank tube. Each of these dies is formed on the rear end of the tapered portion with a land portion for squeezing the blank tube so as to form the blank tube into a required shape.

The land of the preliminary shaping die comprises a pair of first concave curve surface portions each formed on the inner peripheral surface side and having a smaller radius of curvature and a pair of second concave curve surface portions formed on the inner peripheral surface side and having a large radius of curvature, the first and second concave curve surface portions being arranged circumferentially and alternately.

The land of the finishing shaping die comprises a pair of concave curve portions and a pair of flat portions arranged circumferentially and alternately.

According to the method of manufacturing a hollow steering shaft of the present invention, part off a blank tube is drawn so as to be formed into an elliptical shape in cross section, without using a mandrel and without limiting the thickness of the blank tube to a severe value.

The shape of the outer peripheral surface of the blank tube which has passed through the preliminary shaping die is formed into a shape defined by a pair of first convex curve surface portions having a smaller radius of curvature and a pair off second convex surface portions having a larger radius of curvature in conformity with the shape of the inner peripheral surface of the land portion of the preliminary shaping die, the first and second convex surface portions being arranged circumferentially and alternately. By preliminary shaping, the blank tube is formed so as to have an outer peripheral surface consisting of convex curve surface portions over the whole circumference. The blank tube resists well against the forces which are applied in the direction in which the flat portions 13 are bent inward. Thus, the shape of the outer peripheral surface of the blank tube can coincide with the shape of the inner peripheral surface of the land portion of the preliminary shaping die at a high accuracy, even if a mandrel is not used.

After having passed through the preliminary die, the blank tube is inserted into the Finishing shaping die and the second convex curve surface portions are formed into flat portions. Since the deformed amount of the blank tube from the second convex curve surface portions to the flat portions is small, the flat portions do not lose their shape by this deformation.

DETAILED DESCRIPTION OF THE PREFERRED EMBODIMENTS

Figure 1A:
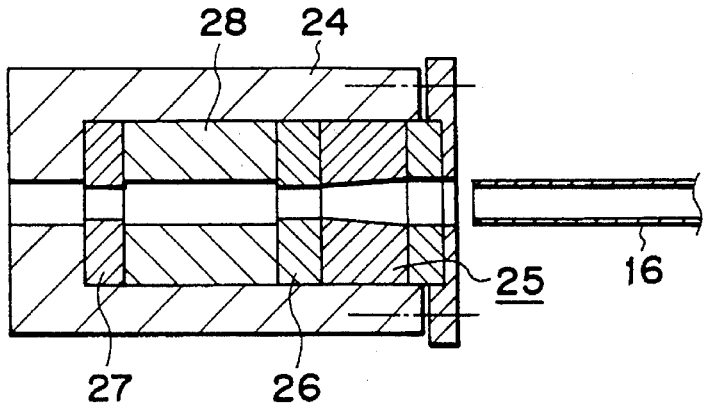
FIGS. 1A to 1C are diagrammatic, longitudinal cross sectional views of one embodiment of the present invention, showing manufacturing processes.

FIGS. 1A to 9 show an embodiment according to the present invention. A manufacturing apparatus which uses a method of manufacturing a hollow steering shaft according to the present invention has a structure as shown in FIGS. 1A to 1C. A preliminary shaping die 25, a finishing shaping die 1 26 and a correction die 27, all being fixed, are arranged coaxially in series in this order from the front side (the right side in FIGS. 1A to 1C) to the rear side (the left side in FIGS. 1A to 1C) in the pushing direction of a blank tube 16 (in the left direction in FIGS. 1A to 1C) in a fixed holding case 24. The preliminary shaping die 25 and the finishing shaping die 26 are disposed adjacent to each other, and the finishing shaping die 26 and the correction die 27 are connected by a spacer 28.

Figure 2:
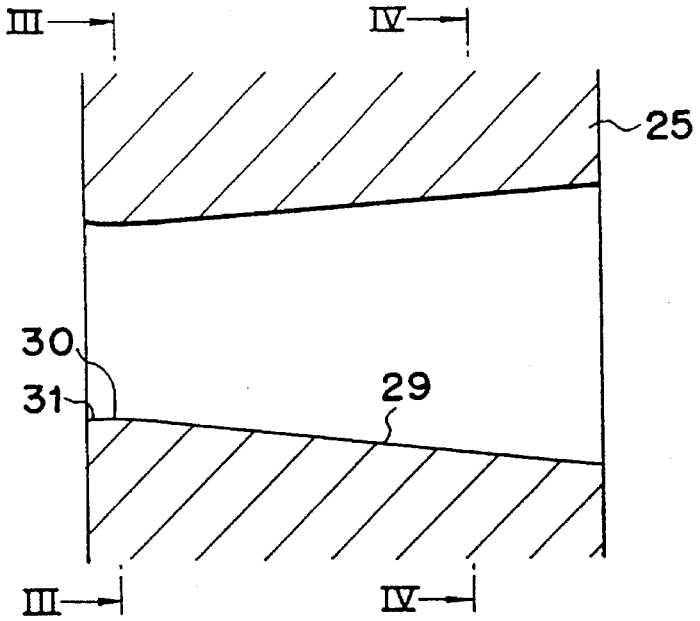
FIG. 2 is a longitudinal cross sectional view of a preliminary shaping die in the Feeding direction of a blank tube.
Figure 3:
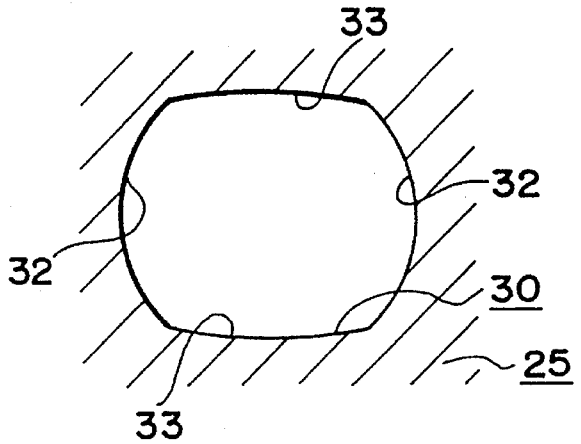
FIG. 3 is a cross-sectional view along line III—III of FIG. 2.
Figure 4:
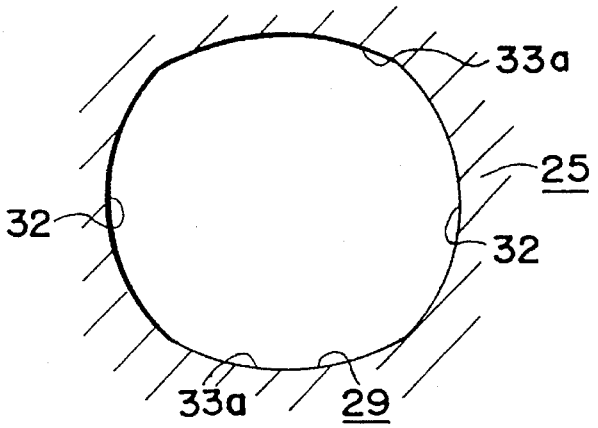
FIG. 4 is a cross-sectional view along line IV—IV off FIG. 2.

The inner peripheral surface of the preliminary shaping die 25 has a shape as shown in FIGS. 2 to 4. This inner peripheral surface comprises a drawing taper portion 29 whose cross-sectional areas becomes gradually smaller toward the rear end in the pushing direction of the blank tube 16, a land portion 30 formed on the rear end of the drawing taper portion 29, and a tapered relief portion 31 having cross-sectional areas which become large as separated more from the land portion 30.

The land portion 30 squeezes the blank tube 16 and forms the same into a predetermined shape and has an inner peripheral surface having a shape as shown in FIG. 3 This peripheral surface of the land portion 30 comprises a pair of first concave curve surface portions 32 having a smaller radius of curvature and a pair of second concave curve surface portions 33 having a larger radius of curvature. The first and second concave curve surface portions 32 and 33 are arranged circumferentially and alternately to form a substantially elliptical shape. The shape of the inner peripheral surface of the drawing taper portion 29 changes from a circle to an ellipse and becomes gradually smaller toward the land portion 30. For example, the shape of an intermediate part of the drawing taper portion 29 has concave portions 33*a* which are contiguous to the second concave surface portions 33 and have a radius of curvature smaller than that of the second concave curve surface portions 33.

Figure 5:
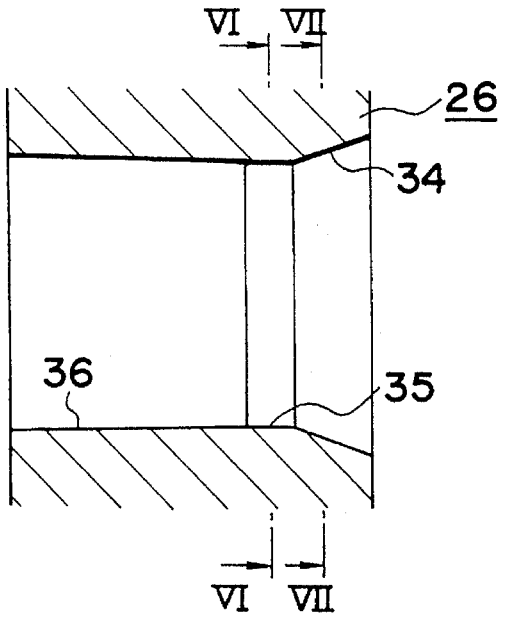
FIG. 5 is a longitudinal cross-sectional view taken in the feeding direction of the blank tube.
Figure 6:
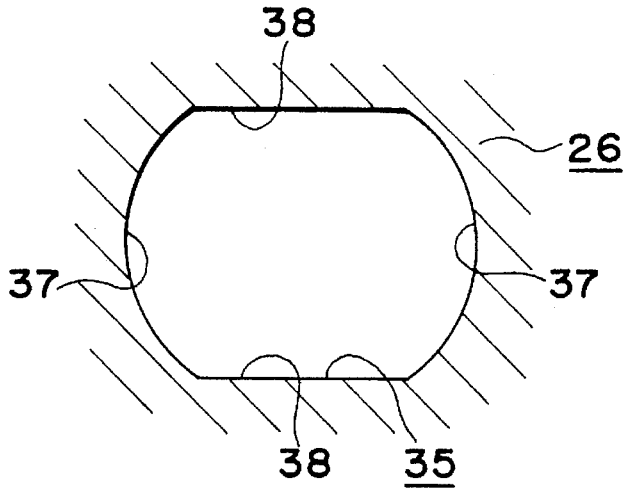
FIG. 6 is a cross-sectional view along line VI—VI of FIG. 5.
Figure 7:
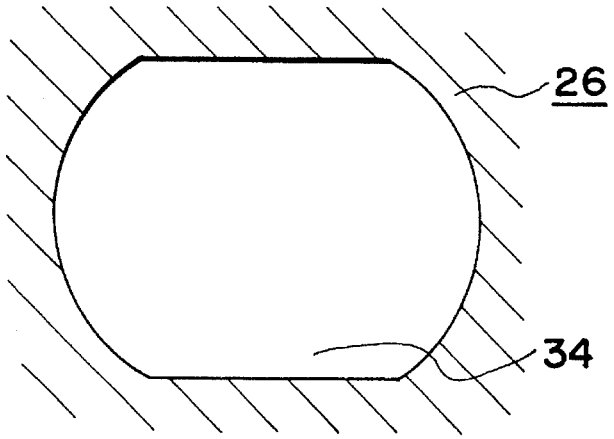
FIG. 7 is a cross-sectional view along line VII—VII of FIG., 5.

The inner peripheral surface of the finishing shaping die 26 has a shape as shown in FIGS. 5 to 7. It comprises a drawing taper portion 34 having sectional areas which become gradually smaller toward the rear end in the pushing direction of the blank tube 16, a land portion 35 formed on the rear end of the drawing taper portion 34, and a relief taper portion 36 having cross-sectional areas which become larger as they are separated from the land portion The land portion 35 squeezes the blank tube 16 and is formed into a predetermined shape. As shown in FIG. 6, it comprises a pair of concave curve surface portions 37 and flat portions 38, which are formed in the finishing shaping die 26 and arranged circumferentially and alternately to take a substantially elliptical shape. As shown in FIG. 7, the cross section off the drawing taper portion has a substantially elliptical shape similar to the land portion 35. The inner peripheral surface of the drawing taper portion 34 is tapered in a conical manner so that the cross-sectional areas become smaller toward the land portion 35. The area of the opening is larger than the cross-sectional area off the preliminary shaping die 25 so that the blank tube 16 which has passed through the land portion 35 is received in the taper portion 34.

The correction die 27 tightly holds the outer peripheral surface of the blank tube 16 which has passed through the finishing shaping die 26 and corrects the shape of the outer peripheral surface of the blank tube 16. The correction die 27 has the same shape as the finishing shaping die 26.

Figure 1B:
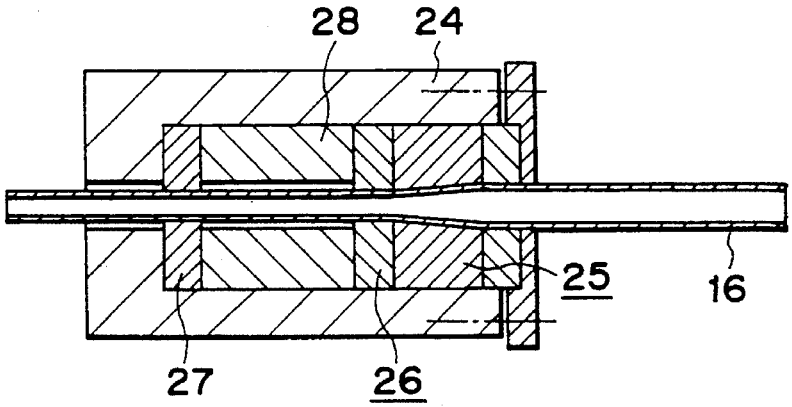

When a hollow steering shaft is manufactured by using the above-mentioned manufacturing apparatus, a blank tube 16 having a circular cross section is disposed in such a manner that the front end portion of the blank tube 16 faces the preliminary shaping die 25 as shown in FIG. 1A, and the blank tube 16 is pushed into the preliminary shaping die 25, as shown in FIG. 1B. As the blank tube 16 is pushed in, it passes through the preliminary shaping die 25 and then is inserted into the Finishing shaping die 26. The blank tube 16 Further passes through the correction die 27 and is formed into a hollow steering shaft having a substantially elliptical shape in cross section.

Figure 8:
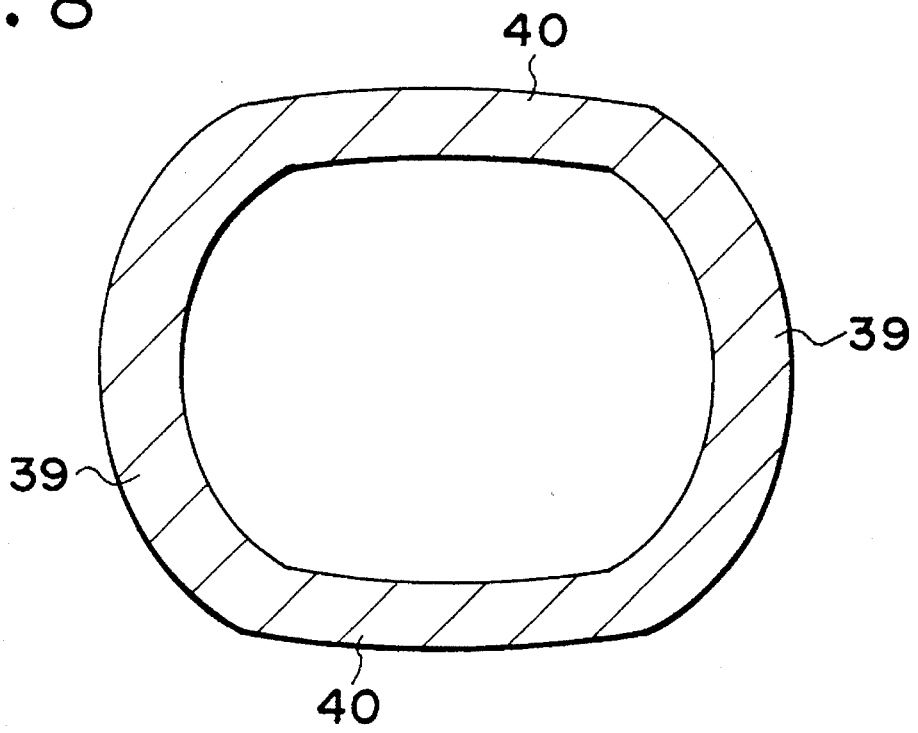
FIG. 8 is a transverse cross-sectional view of the blank tube after having passed through the preliminary shaping die.

The outer peripheral surface of the blank tube 16 which has passed through the preliminary shaping die 25 is formed into a shape in conformity 10 with the shape of the inner peripheral surface of the land portion 30 of the preliminary shaping die 25, as shown in FIG. 8. After having passed through the land portion 30, the blank tube 16 is formed into a substantially elliptical shape defined by a pair of first convex curve surface portions 39 having a smaller radius of curvature and a pair of second convex curve surface portions 40 having a larger radius of curvature, which are arranged circumferentially and alternately.

Figure 17:
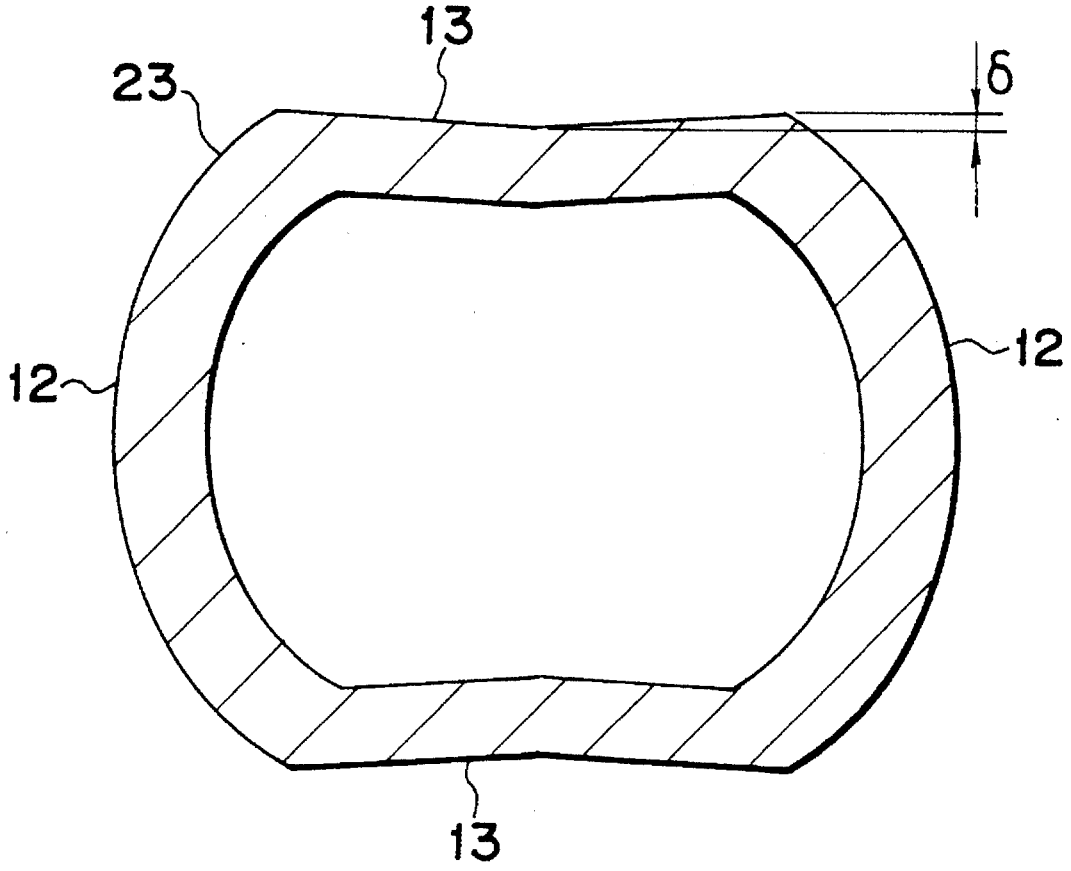
FIG. 17 PRIOR ART
FIG. 17 is a transverse cross-sectional view of the deformed blank tube after having been shaped.

Since the outer peripheral surface of the blank tube 16 is defined by convex curve surfaces provided over the whole circumference of the blank tube 16, the flat portions 13 are not bent inward as shown in FIG. 17, even though the mandrel 21 (FIGS. 13A to 13E) is omitted. Thus, the shape of the outer peripheral surface of the blank tube 16 can coincide with the shape of the inner peripheral surface of the land portion 30 of the preliminary shaping die 25 at a high accuracy.

Figure 9:
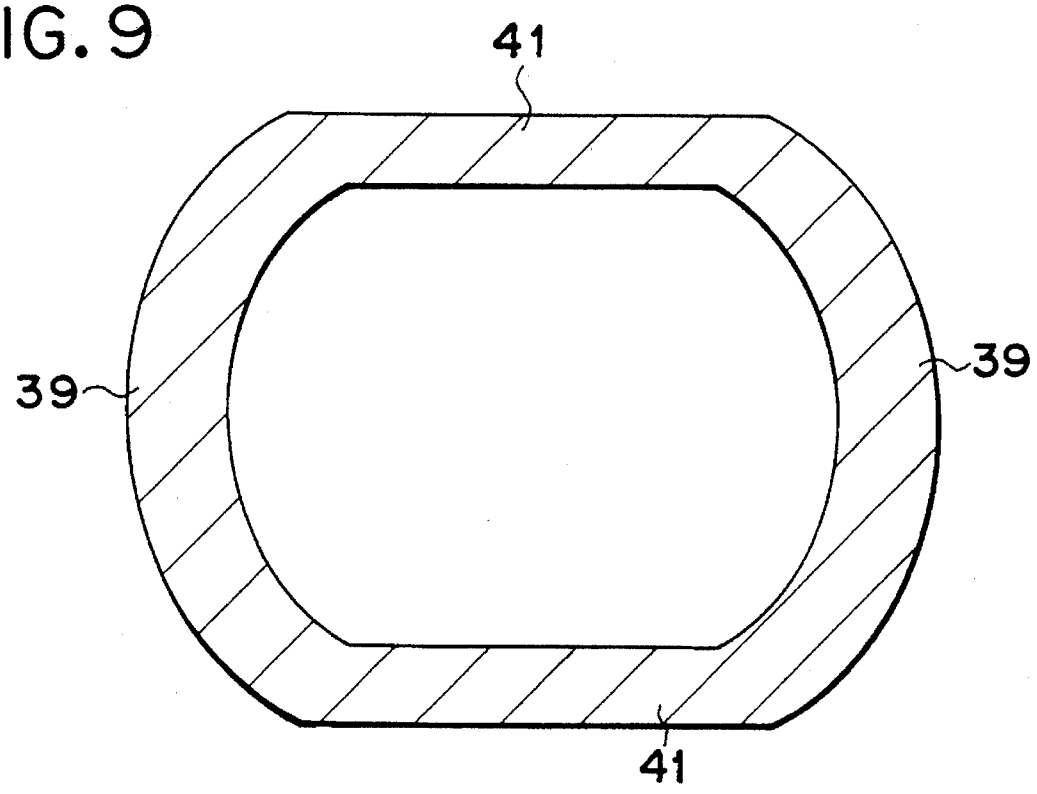
FIG. 9 is a transverse cross-sectional view of the blank tube after having passed through the finishing shape die.
Figure 10:
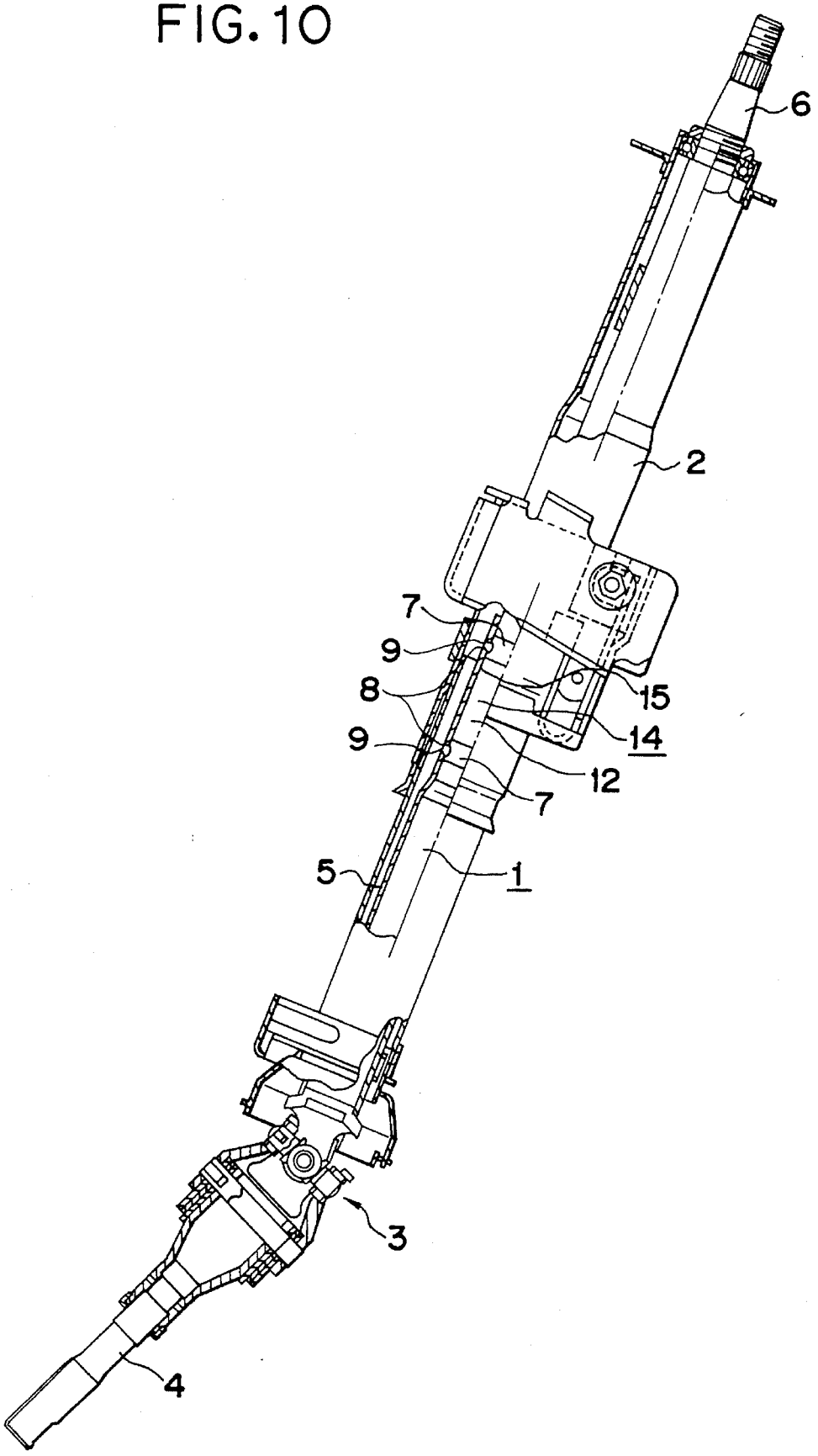
FIG. 10 is a partially broken side view of a steering apparatus in which a steering shaft is assembled.

The blank tube 16 which has passed through the preliminary shaping die 25 is guided as it is to be drawing taper portion 34 of the finishing shaping die 26 and pushed into the land portion 35 of the finishing shaping die 26. As a result, the second convex curve surface portions 40 formed on the blank tube 16 are deformed into flat portions 41, as shown in FIG. 9. Since the amount of deformation from the second convex curve surface portions 40 to the flat portions 41 is small, the shape of the flat portions 41 does not change by this deformation.

Figure 1C:
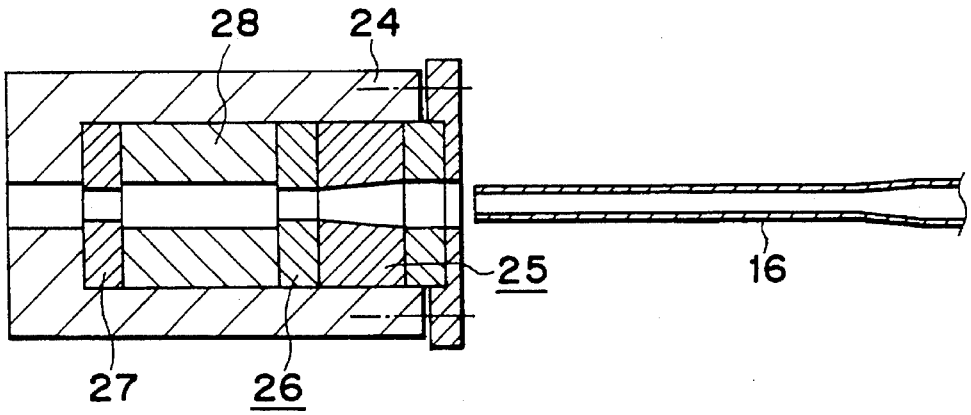
Figure 11:
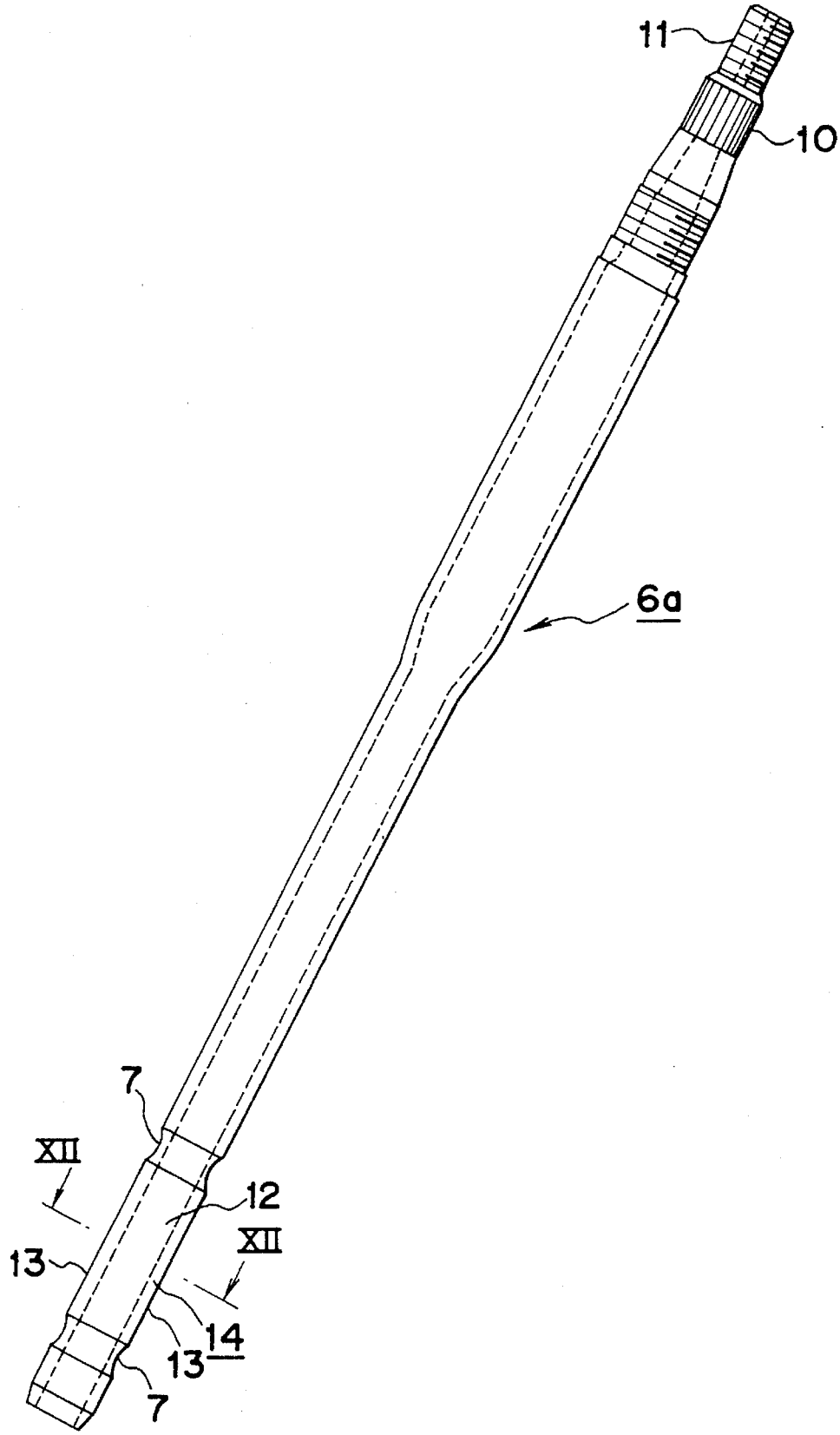
FIG. 11 is a side view of a hollow steering shaft which is an object of the present invention.
Figure 12:
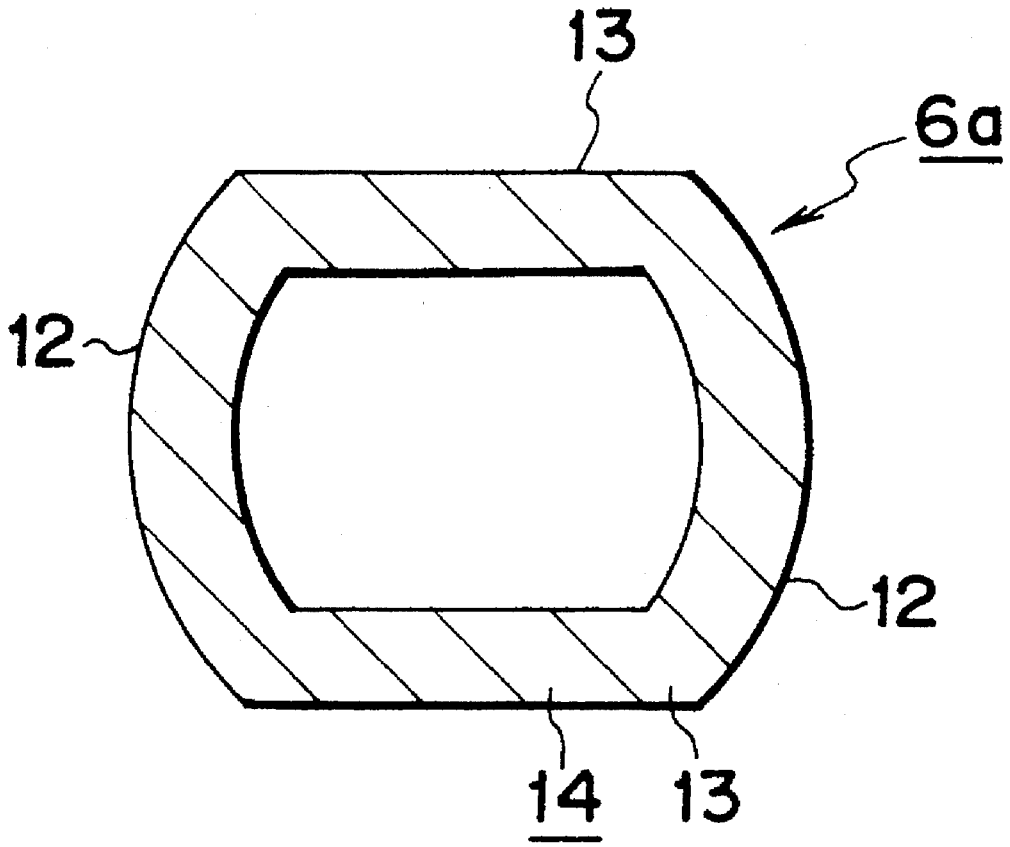
FIG. 12 is a cross-sectional view along line XII—XII of FIG. 11.
Figure 13A:
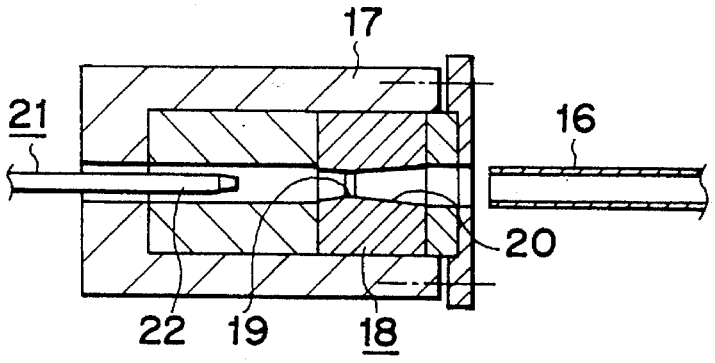
FIG. 13A PRIOR ART
FIGS. 13A to 13E are longitudinal cross sectional views of the processes of a conventional method of manufacturing a hollow steering shaft.
Figure 13B:
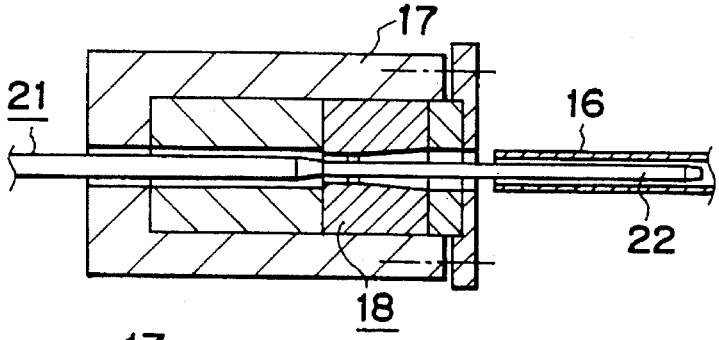
FIG. 13B PRIOR ART
Figure 13C:
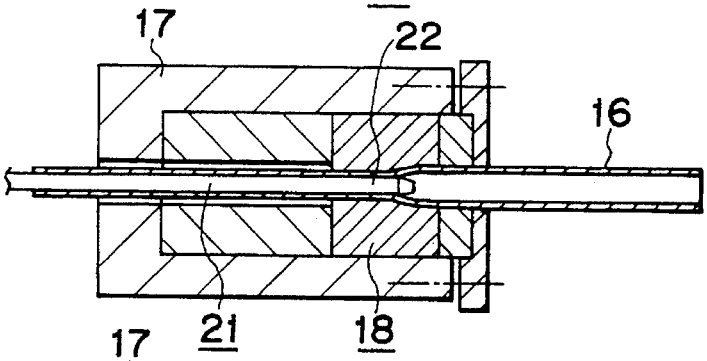
FIG. 13C PRIOR ART
Figure 13D:
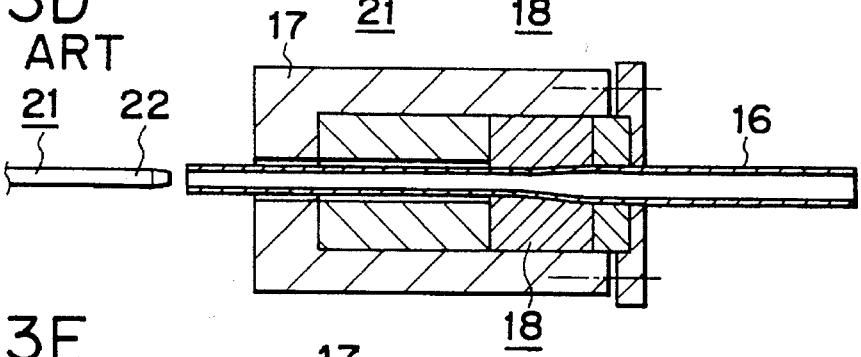
FIG. 13D PRIOR ART
Figure 13E:
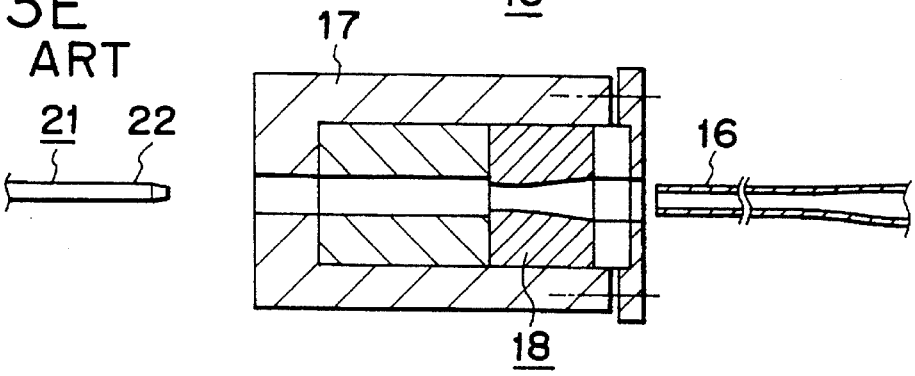
FIG. 13E PRIOR ART
Figure 14:
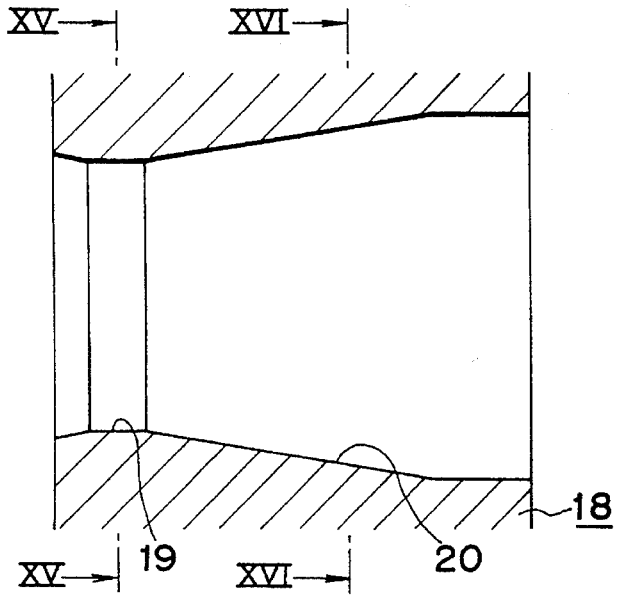
FIG. 14 is a longitudinal cross-sectional view of a shaping die taken in the Feeding direction of the blank tube.
Figure 15:
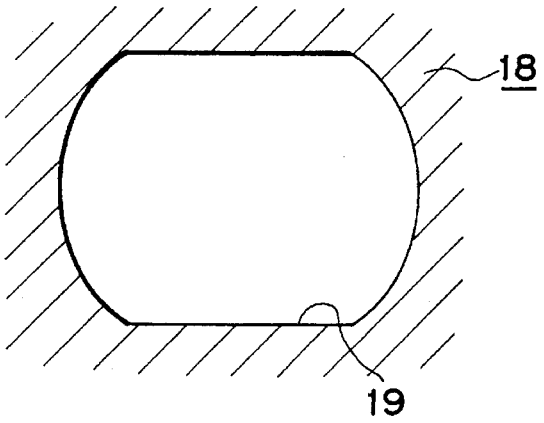
FIG. 15 is a cross-sectional view along line XV—XV of FIG. 14.
Figure 16:
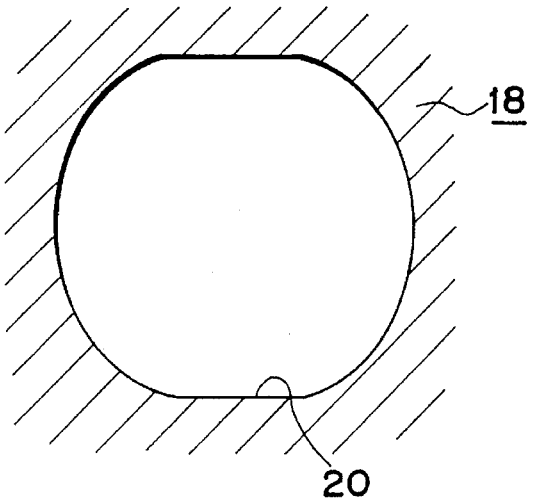
FIG. 16 is a cross-sectional view along line XVI—XVI of FIG. 14.

The blank tube 16, which has passed through the land portion 35 of the finishing shaping die 26 and is formed into a substantially elliptical shape in cross section as shown in FIG. 9, is Fed to the correction die 27 so that the shape of the blank tube 16 in which high accuracies of straightness and the like are required is corrected. After each portion of the blank tube 16 has been formed into its required shape having required dimensions, the blank tube 16 is pulled out of the dies 25 to 27, as shown in FIG. 1C. Thereafter, the blank tube 16, part of which has been drawn into a substantially elliptical shape, is transported to another station in which the blank tube 16 is formed with annular grooves 7 and the like. In this way, the blank tube 16 is formed into an upper shaft 6*a* of the steering shaft 1 (FIGS. 11 and 12).

With the method of manufacturing a hollow steering shaft according to the present invention, a steering shaft having a good quality can be manufactured without and without using a mandrel. Experiments made by the inventors of the present invention in order to confirm the technical advantages of the present invention will be explained.

The conditions of the experiments are as follows.

| Blank Pipes | |
|---|---|
| Material: | STKM15A |
| Outer Diameter: | 21.7 mm |
| Thickness: | 2.6 mm |
| Length: | 380 mm |
| Pipe to be Drawn: | electric resistance welded blank tubes (blank tubes which are not yet drawn after having been electric-resistance welded) |
| Shape to be Drawn: | 21.5 mm × 16 mm (substantially elliptical) |

The blank pipes were drawn in three processes A, B and C.

A. Conventional process

The process in which a mandrel 21 was used as shown in FIGS. 13A to 13E.

B. Process For a Comparative Purpose

The process which was conventional as shown in FIGS. 13A to 13E but in which a mandrel 21 was not used.

C. Process of the Present Invention

The process in which a preliminary shaping die 25, a finishing die 26 and a correction die 27 were used as described above.

The results of the experiments in the three processes are listed as follows:

| Processes | Shaping Loads P (kgf) | Bending of Flat Portions Having Elliptical Cross Section δ (mm) | Contraction Loads Upon Collision W (Standard 150–300 kg) | Axial Elongations e (mm) (Variations Δ e) | Accuracies Required for Material (Variations of Thickness) |
|---|---|---|---|---|---|
| A | 3,400–7,000 (Buckled) | 0.01–0.05 | 210–280 | 9.0–14.9 (5.9) | Not more than 0.05 mm |
| B | 2,600 | 0.09–0.12 | 100–500 | 4.0–4.3 (0.3) | No limit |
| C | 2,600 | Not more than 0.02 | 220–270 | 4.0–4.3 (0.3) | No limit |

In the table, the shaping loads P are the forces required for pushing the blank tubes into the die. The smaller, the more preferable the shaping loads are. In the process A, an example of a steering shaft to which the shaping load of 7,000 kgf was applied was buckled and could not be drawn. The bending δ of flat portions 41 is the amount of the inward bending of intermediate parts of the flat portions, as shown in FIG. 17. When the flat portions 41 are bent inward in a steering shaft 1 formed by assembling an upper shaft *6a* and a lower shaft 5 together, the loads required for shrinking the steering shaft 1 (contraction loads W at the time of collision) vary and become large. If the loads 1B increase, the driver cannot always be protected well upon collision. Thus, the loads must be decreased and be stabilized. The axial elongation e is an amount of elongation of the overall length of a blank tube due to drawing operation. It is preferable that variation of the elongation be as small as possible in order to omit cutting operation of upper shafts *6a* to a predetermined length.

As apparent from the list showing the results of the above-mentioned experiments, the present invention has the following technical merits:

(1) A hollow steering shaft can be manufactured without limiting the dimensional accuracies of the blank tube 16 including the thickness accuracy to strict values.

(2) The structure of the shaping apparatus is simple and the apparatus cost is low because no mandrel is used.

(3) The shaping loads are low because no mandrel is used and the shape of the cross section of the blank tube can be changed without reducing the thickness of the blank tube 16. Thus, the land portions of the shaping dies 25 to 27 are less worn and the shaping dies 25 to 27 need not be replaced so frequently. This results in a lower manufacturing cost.

(4) The axial elongation of the overall length of a blank tube 16, due to drawing operation, not to mention the variations, becomes small, and the cutting operation of the blank tube 16 after the drawing operation can be omitted, whereby the manufacturing cost will be reduced.

Upon working the present invention under the above-mentioned conditions, it was found that the order of 0.4 mm of the projection of the central part of each second concave curve surface portion 33 of the preliminary shaping die 25 from both ends of the die 25 was preferable. Although not shown in the drawing, a preliminary shaping die 25 and a finishing shaping die 26 can be integrally formed by electric discharge machining or the like.

With the method of manufacturing a hollow steering shaft according to the present invention, a steering shaft having a good quality can be manufactured at a low cost, because the present invention is constructed and worked in the above-mentioned manner.

What is claimed is:

1. A hollow steering shaft manufactured by the steps of passing part of a blank tube having a circular cross section through a preliminary shaping die and then through a finishing shaping die to form a pair of arcuate portions and a pair of flat portions in said blank tube, said arcuate portions and said flat portions being arranged circumferentially and alternately, each of said preliminary shaping die and said finishing shaping die comprising:

a drawing taper portion having cross-sectional areas which become smaller in a direction in which said blank tube is pushed;

a land portion formed on an end of said drawing taper portion having the smallest cross-sectional area, said land portion being adapted to squeeze said blank tube to form said blank tube into a predetermined shape, the land portion of said preliminary shaping die comprising a pair of first concave curve surface portions having a smaller radius of curvature and a pair of second concave curve surface portions having a larger radius of curvature, said first and second concave curve surface portions being arranged circumferentially and alternately, and the land portion of said finishing shaping die comprising a pair of third concave curve surface portions and flat portions, said third concave curve surface portions and said flat portions being arranged circumferentially and alternately.

2. A method of manufacturing a hollow steering shaft including the steps of passing part of a blank tube having a circular cross section through a preliminary shaping die and then through a finishing shaping die and forming a pair of arcuate portions and a pair of flat portions arranged circumferentially and alternately in said blank tube, each of said preliminary shaping die and said finishing shaping die comprising:

a drawing taper portion having cross-sectional areas which become gradually smaller in a direction in which said blank tube is pushed; and a land portion on an end of said drawing taper portion having the smallest cross-sectional area, said land portion squeezing said blank tube to form said blank tube into a predetermined shape, the land portion of said preliminary shaping die having a pair of first concave curve surface portions having a smaller radius of curvature and a pair of second concave curve surface portions having a larger radius of curvature, said first and second concave curve surface portions being arranged circumferentially and alternately, and the land portion of said finishing shaping die having a pair of third concave curve surface portions and flat portions, said third concave curve surface portions and said flat portions being arranged circumferentially and alternately.

* * * * *